US007934881B2

(12) United States Patent
Lodwig et al.

(10) Patent No.: US 7,934,881 B2
(45) Date of Patent: May 3, 2011

(54) REPLACEABLE RIBBON SUPPLY AND SUBSTRATE CLEANING APPARATUS

(75) Inventors: Dean H. Lodwig, West Hills, CA (US); Caleb J. Bryant, Moorpark, CA (US); Lionel C. Chavarria, Moorpark, CA (US); Daniel E. Perry, Camarillo, CA (US)

(73) Assignee: ZIH Corp., Hamilton (BM)

( * ) Notice: Subject to any disclaimer, the term of this patent is extended or adjusted under 35 U.S.C. 154(b) by 1011 days.

(21) Appl. No.: 11/379,279

(22) Filed: Apr. 19, 2006

(65) Prior Publication Data

US 2007/0086823 A1 Apr. 19, 2007

Related U.S. Application Data

(60) Provisional application No. 60/672,642, filed on Apr. 19, 2005.

(51) Int. Cl.
*B41J 32/00* (2006.01)
*B41J 17/32* (2006.01)

(52) U.S. Cl. ..... 400/208; 347/214

(58) Field of Classification Search ..... 400/207, 400/208, 208.1; 347/214; D18/12; *B41J 32/00, B41J 17/32*

See application file for complete search history.

(56) References Cited

U.S. PATENT DOCUMENTS

| | | | | |
|---|---|---|---|---|
| 3,151,724 | A | | 10/1964 | Ross et al. |
| 4,160,605 | A | | 7/1979 | Neubaum et al. |
| 4,350,453 | A | | 9/1982 | Field et al. |
| 4,519,600 | A | | 5/1985 | Warwick et al. |
| 4,644,370 | A | | 2/1987 | Watanabe |
| 4,669,899 | A | | 6/1987 | Kawakami et al. |
| 4,676,678 | A | | 6/1987 | Watanabe |
| 4,733,980 | A | | 3/1988 | Tosa |
| 4,983,056 | A | | 1/1991 | Falconieri et al. |
| 5,078,523 | A | | 1/1992 | McGourty et al. |
| 5,128,763 | A | | 7/1992 | Sakuragi |
| 5,243,360 | A | * | 9/1993 | Tomoda et al. ..... 347/214 |
| 5,266,968 | A | | 11/1993 | Stephenson |
| 5,318,370 | A | | 6/1994 | Nehowig |

(Continued)

FOREIGN PATENT DOCUMENTS

CH 574 820 A5 4/1976

(Continued)

OTHER PUBLICATIONS

International Search Report for PCT/US2005/000795, Mailed Aug. 5, 2005.

(Continued)

*Primary Examiner* — Leslie J Evanisko
(74) *Attorney, Agent, or Firm* — Alston & Bird LLP

(57) ABSTRACT

A ribbon cartridge for a printer. The ribbon cartridge includes a frame that supports supply and take-up spools and that has one or more locating features to facilitate its insertion and positioning in a frame of a printer. For example, the ribbon cartridge frame may include a pair of detents defined approximately midway between the two spools to facilitate balanced insertion. The detents are slots with rounded ends that are configured to receive similarly shaped reference protrusions of the printer frame. The cartridge frame may also define a pocket for receiving an identification tag associated with the ribbon cartridge that ensures compatibility with the printer and passage of other information to the printer. In other embodiments, the ribbon cartridge may include a cleaning roller.

13 Claims, 12 Drawing Sheets

U.S. PATENT DOCUMENTS

| | | | |
|---|---|---|---|
| 5,326,179 | A | 7/1994 | Fukai et al. |
| 5,385,416 | A | 1/1995 | Maekawa et al. |
| 5,401,111 | A | 3/1995 | Nubson et al. |
| 5,415,486 | A | 5/1995 | Wouters et al. |
| 5,455,617 | A | 10/1995 | Stephenson et al. |
| 5,503,382 | A | 4/1996 | Hansen et al. |
| 5,529,411 | A | 6/1996 | Nakata et al. |
| 5,546,115 | A | 8/1996 | Nardone et al. |
| 5,558,449 | A | 9/1996 | Morgavi |
| D374,452 | S | 10/1996 | Sato |
| 5,584,589 | A | 12/1996 | Adkins et al. |
| 5,610,635 | A | 3/1997 | Murray et al. |
| 5,620,265 | A | 4/1997 | Kondo |
| D379,195 | S | 5/1997 | Stanton |
| 5,646,660 | A | 7/1997 | Murray |
| 5,667,316 | A | 9/1997 | Nardone et al. |
| 5,680,106 | A | 10/1997 | Schrott et al. |
| D391,286 | S | 2/1998 | Mizusugi |
| 5,769,407 | A | 6/1998 | Hansen |
| 5,771,058 | A | 6/1998 | Kobayashi |
| 5,806,843 | A | 9/1998 | Hansen et al. |
| 5,810,490 | A | 9/1998 | Kondo |
| 5,825,392 | A | 10/1998 | Mochizuki |
| 5,835,817 | A | 11/1998 | Bullock et al. |
| 5,836,580 | A | 11/1998 | Hansen et al. |
| 5,860,753 | A | 1/1999 | Beck et al. |
| 5,871,209 | A | 2/1999 | Orchard et al. |
| 5,872,585 | A | 2/1999 | Donato et al. |
| 5,959,278 | A | 9/1999 | Kobayashi et al. |
| 5,959,652 | A | 9/1999 | Privin et al. |
| 5,962,832 | A | 10/1999 | Dorner |
| 5,984,546 | A | 11/1999 | Kameyama |
| 5,986,683 | A | 11/1999 | Sawano et al. |
| 6,000,773 | A | 12/1999 | Murray et al. |
| 6,109,801 | A | 8/2000 | Mabit |
| 6,151,037 | A | 11/2000 | Kaufman et al. |
| 6,227,643 | B1 | 5/2001 | Purcell et al. |
| 6,234,696 | B1 | 5/2001 | Whittaker |
| 6,236,420 | B1 | 5/2001 | Matsuzaka |
| D443,890 | S | 6/2001 | Sato et al. |
| 6,285,845 | B1 | 9/2001 | Liatard et al. |
| 6,305,855 | B1 | 10/2001 | Bryer et al. |
| 6,386,772 | B1 | 5/2002 | Klinefelter et al. |
| 6,408,151 | B1 | 6/2002 | Heno |
| 6,448,991 | B1 | 9/2002 | Doan |
| 6,457,886 | B1 | 10/2002 | Meier |
| 6,554,512 | B2 | 4/2003 | Heno et al. |
| 6,567,112 | B2 | 5/2003 | Suzuki |
| 6,582,141 | B2 | 6/2003 | Meier et al. |
| 6,587,135 | B1 | 7/2003 | Suzuki et al. |
| 6,609,844 | B1 | 8/2003 | Petteruti et al. |
| 6,648,527 | B2 | 11/2003 | Takahashi et al. |
| 6,669,186 | B2 | 12/2003 | Tunink et al. |
| 6,676,312 | B2 | 1/2004 | Richard |
| 6,679,489 | B2 | 1/2004 | Casto et al. |
| 6,694,884 | B2 | 2/2004 | Klinefelter et al. |
| D487,479 | S | 3/2004 | Paulson et al. |
| 6,722,649 | B2 | 4/2004 | Yui |
| D491,217 | S | 6/2004 | Miyauchi et al. |
| 6,798,434 | B2 | 9/2004 | Shibata et al. |
| 6,808,327 | B2 | 10/2004 | Iwata |
| 6,840,689 | B2 | 1/2005 | Barrus et al. |
| 6,848,845 | B2 | 2/2005 | Poole |
| 6,877,918 | B2 | 4/2005 | Takahashi et al. |
| 7,018,117 | B2 | 3/2006 | Meier et al. |
| D527,044 | S | 8/2006 | Harden et al. |
| 7,137,000 | B2 | 11/2006 | Hohberger et al. |
| 7,170,537 | B2 | 1/2007 | Helma et al. |
| 7,198,262 | B2 | 4/2007 | Hartl et al. |
| 7,206,010 | B2 | 4/2007 | Maghakian |
| 7,328,897 | B2 | 2/2008 | Bryant et al. |
| 7,344,325 | B2 | 3/2008 | Meier et al. |
| 2002/0106229 | A1 | 8/2002 | Meier et al. |
| 2003/0059050 | A1 | 3/2003 | Hohberger et al. |
| 2003/0164982 | A1 | 9/2003 | Lien |
| 2004/0018035 | A1 | 1/2004 | Petteruti et al. |
| 2004/0114981 | A1 | 6/2004 | Meier et al. |
| 2005/0052491 | A1 | 3/2005 | Helma et al. |
| 2006/0216098 | A1 | 9/2006 | Lyman |
| 2006/0251461 | A1 | 11/2006 | Lodwig et al. |
| 2007/0023068 | A1 | 2/2007 | Helma |
| 2007/0031617 | A1 | 2/2007 | Field |
| 2007/0063092 | A1 | 3/2007 | Zevin et al. |
| 2007/0086823 | A1 | 4/2007 | Lodwig et al. |
| 2007/0286660 | A1 | 12/2007 | Maghakian |

FOREIGN PATENT DOCUMENTS

| | | | | |
|---|---|---|---|---|
| DE | 25 35 699 | | | 3/1977 |
| EP | 0 562 979 | A2 | | 9/1993 |
| EP | 0 622 242 | A | | 11/1994 |
| EP | 0 979 736 | A1 | | 2/2000 |
| EP | 0 887 197 | A3 | | 5/2000 |
| EP | 1 095 783 | B1 | | 12/2003 |
| GB | 2 120 821 | A | | 12/1983 |
| JP | 55-55880 | | | 4/1980 |
| JP | 55-158988 | | | 12/1980 |
| JP | 57-123084 | | | 7/1982 |
| JP | 59-1290 | | | 1/1984 |
| JP | 59-199279 | | | 11/1984 |
| JP | 60-155487 | | | 8/1985 |
| JP | 63 286361 | A | | 11/1988 |
| JP | 63-197163 | | | 12/1988 |
| JP | 63 295283 | A | | 12/1988 |
| JP | 1-135680 | | | 5/1989 |
| JP | 2-36460 | | | 3/1990 |
| JP | 2-171275 | | | 7/1990 |
| JP | 3-121861 | | | 12/1991 |
| JP | 4-122669 | | | 4/1992 |
| JP | 4-128078 | | | 4/1992 |
| JP | 4-220385 | | | 8/1992 |
| JP | 4-221670 | | | 8/1992 |
| JP | 5-96803 | | | 4/1993 |
| JP | 5-96836 | | | 4/1993 |
| JP | 5-169696 | | | 7/1993 |
| JP | 5-177914 | | | 7/1993 |
| JP | 5-318865 | | | 12/1993 |
| JP | 6-99631 | | | 4/1994 |
| JP | 6-143774 | | | 5/1994 |
| JP | 6-227679 | | | 8/1994 |
| JP | 6-81750 | | | 11/1994 |
| JP | 6-320764 | | | 11/1994 |
| JP | 7-42697 | | | 8/1995 |
| JP | 08058172 | A | * | 3/1996 |
| JP | 8-90880 | | | 4/1996 |
| JP | 8-332764 | | | 12/1996 |
| JP | 9-39348 | | | 2/1997 |
| JP | 9-141987 | | | 6/1997 |
| JP | 9-254479 | | | 9/1997 |
| JP | 9-272213 | | | 10/1997 |
| JP | 9272239 | | | 10/1997 |
| JP | 10-29327 | | | 2/1998 |
| JP | 11-105359 | | | 4/1999 |
| JP | 11-265463 | | | 9/1999 |
| JP | 2000-015911 | | | 1/2000 |
| JP | 2000-246985 | | | 9/2000 |
| JP | 2000-335065 | | | 12/2000 |
| JP | 2001-205906 | | | 7/2001 |
| JP | 2002-120446 | | | 4/2002 |
| JP | 2002-137433 | | | 5/2002 |
| JP | 2002-178585 | | | 6/2002 |
| WO | WO 95/09084 | A1 | | 4/1995 |
| WO | WO 99/04368 | A1 | | 1/1999 |
| WO | WO 99/21713 | A1 | | 5/1999 |
| WO | WO 99/49379 | A2 | | 9/1999 |
| WO | WO 02/32200 | A | | 4/2002 |
| WO | WO 03/019459 | A3 | | 3/2003 |
| WO | WO 2004/011268 | A1 | | 2/2004 |

OTHER PUBLICATIONS

International Search Report for PCT/US2004/032053, Mailed Feb. 16, 2005.

European Search Report for EP 06006810.3, completed on Jul. 21, 2006.

* cited by examiner

FIG. 2
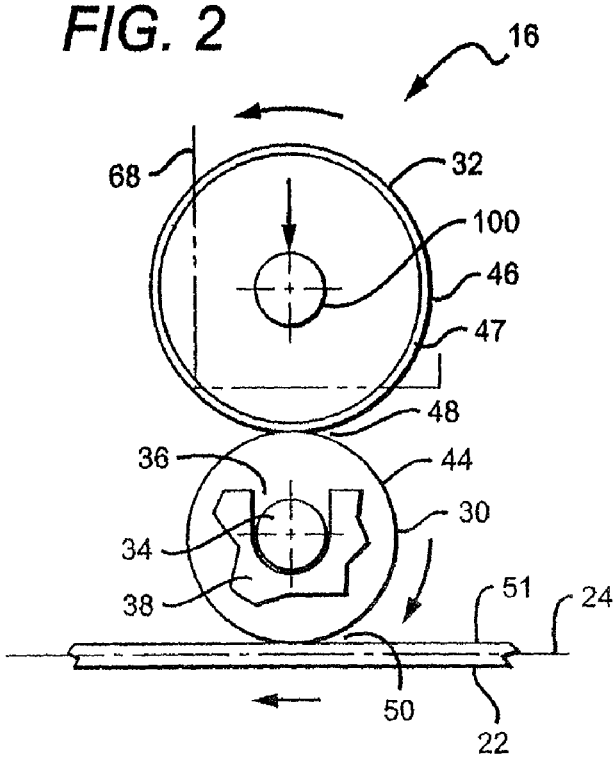
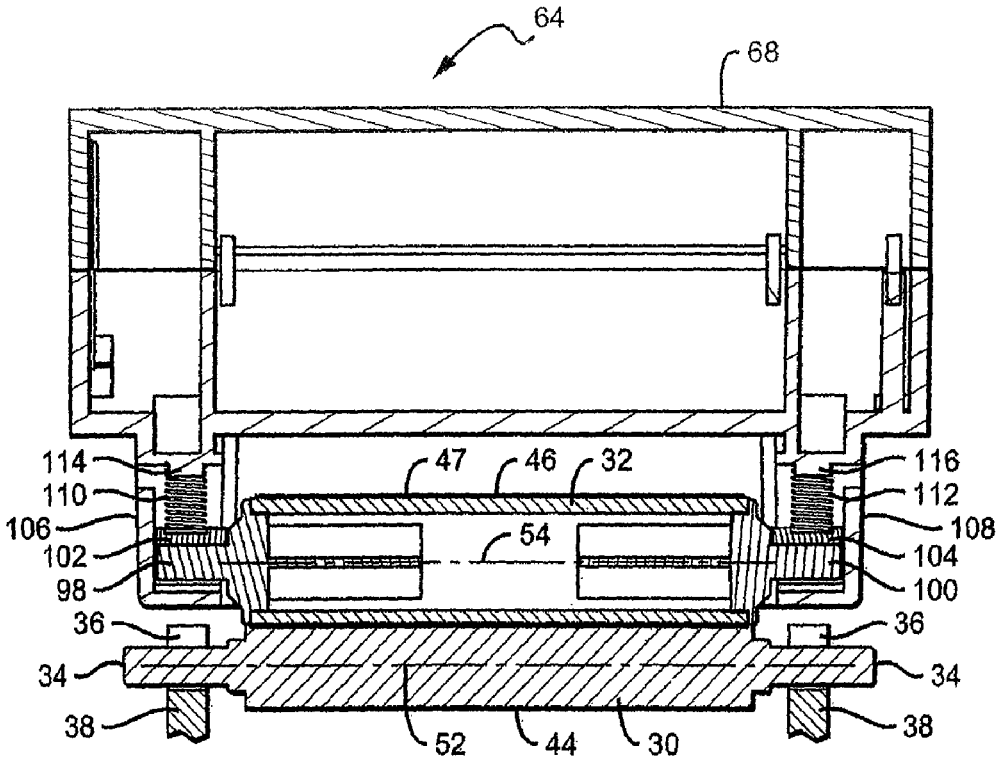
FIG. 3

FIG. 4
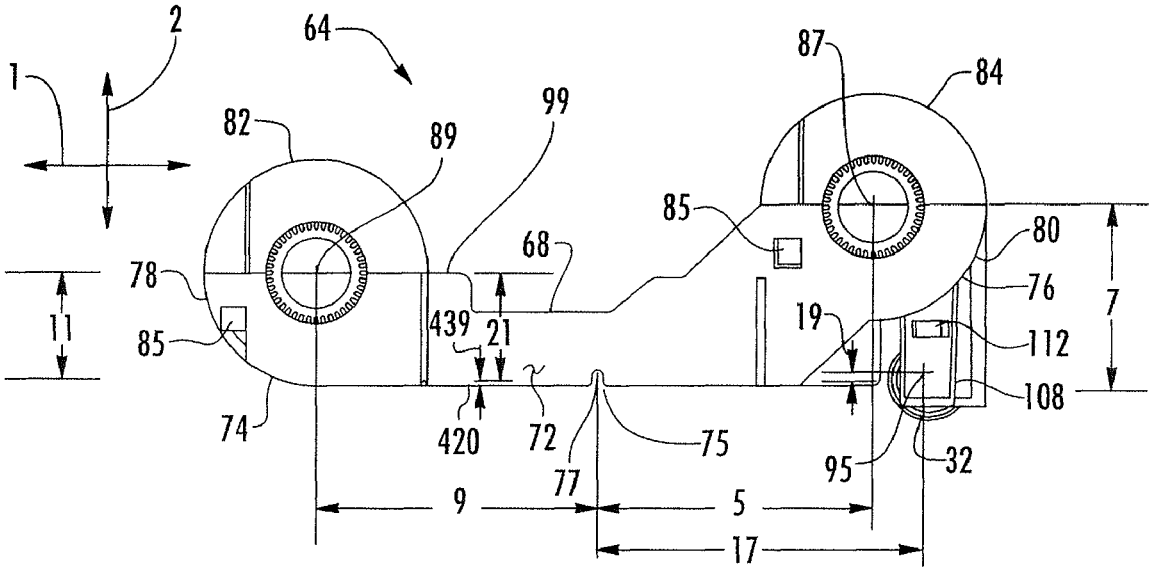
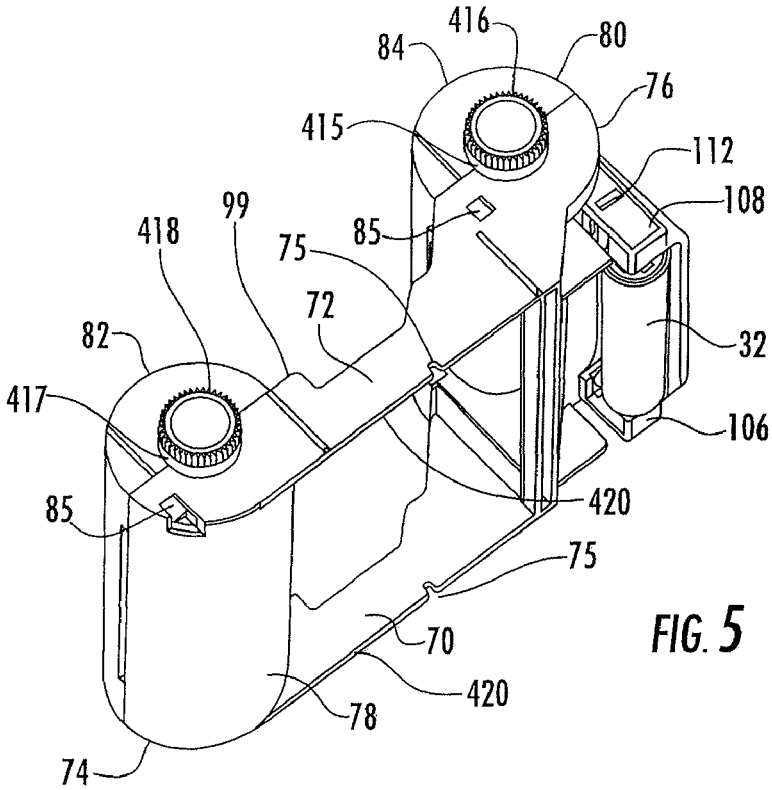
FIG. 5

FIG. 6
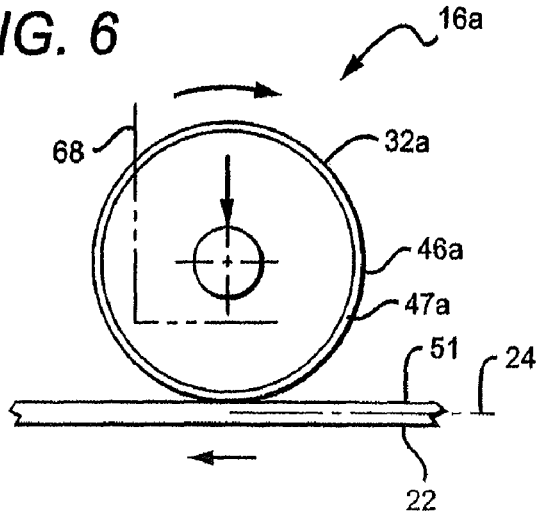
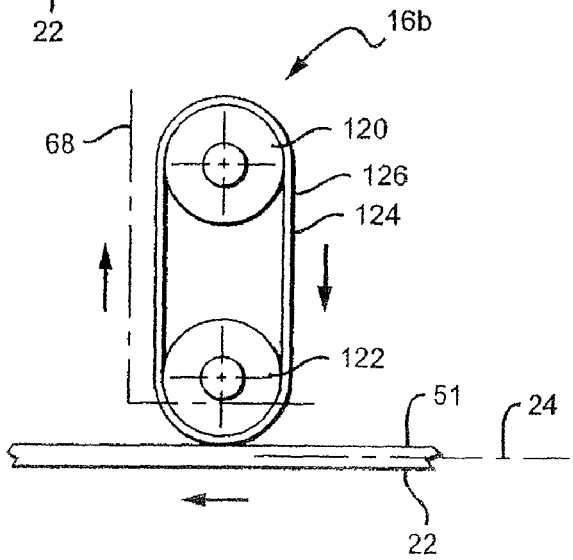
FIG. 7
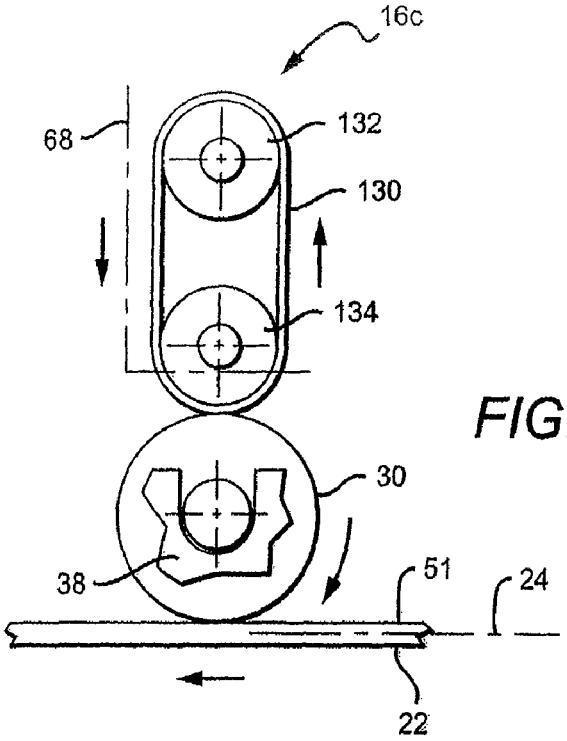
FIG. 8

REPLACEABLE RIBBON SUPPLY AND SUBSTRATE CLEANING APPARATUS

CROSS-REFERENCES TO RELATED APPLICATIONS

This application claims priority to U.S. Provisional Application Ser. No. 60/672,642, filed Apr. 19, 2005, and to copending U.S. patent application Ser. No. 10/690,395, filed on Oct. 20, 2003, both of which are hereby incorporated herein in their entirety by reference.

FIELD OF THE INVENTION

The present invention relates generally to printers for printing on discrete, flexible, information-bearing substrates such as plastic cards, and particularly to an apparatus receivable in a printer that is self-locating and accurately positions interfacing components used in printing on the substrates and removing particulate matter such as dust and/or other debris from the substrates.

BACKGROUND OF THE INVENTION

Printers for printing information on discrete, flexible substrates such as plastic identification cards, drivers licenses, prepaid cards, and the like, conventionally comprise a substrate hopper and feeder for storing and supplying a succession of individual substrates to be printed; a substrate cleaning station for cleaning the surface of each substrate prior to printing; a print station typically comprising a thermal printhead cooperating with a thermal transfer ribbon or dye sublimation ribbon to print the information on the information-receiving surface of the substrate; and a discharge station for receiving the printed substrates.

The thermal printhead is actuated by a drive mechanism to move the head toward and away from a platen roller in synchronization with the sequential transportation of the substrates past the print station. Printing is effected through the thermal transfer or dye sublimation ribbon positioned between the printhead and the substrate. The thermal printhead has a transverse tip carrying a large number of heatable elements selected ones of which are energized to transfer an ink or a dye from the ribbon to the substrate. The ribbon is typically carried by a replaceable ribbon cartridge that is disposed of when the ribbon is spent. After a spent cartridge is disposed of, another cartridge of the same design is inserted into the machine to replenish the ribbon supply. Thus, multiple cartridges may be installed in a single printer and there are components of a printer that must interface with components of the replaceable cartridge, including the components carrying the ribbon.

As is known, the printable surface of information-bearing substrates and particularly those in the form of cards made of plastics such as PVC, must be clean so as to provide a high quality representation of the printed information (and particularly so where the information is applied by a high temperature thermal printing process) and to protect the printhead from being damaged. A substrate cleaning station is therefore provided upstream of the printing station. The cleaning station typically comprises a cleaning platen roller that rides in contact with the information-receiving surface of each of the substrates successively fed through the printer. The cleaning platen roller has a surface of, for example, silicone, treated to make the surface tacky so as to lift particulate matter such as dust and/or other debris (hereinafter "debris") from the print-receiving substrate surface. It will be evident that as the tacky surface of the cleaning roller accumulates debris the roller will lose its effectiveness so that the cleaning roller itself needs to be kept clean. Alternatively, the cleaning roller must be replaced when the tacky surface becomes saturated with debris.

In one approach, the tacky cleaning roller is periodically cleaned by means of a sticky debris removal member in the form of a sticky tape fed from a tape supply roll against the surface of the tacky cleaning roller and from there to a tape take-up roll. The sticky tape supply and take-up rolls are carried by a tape carrier. When the sticky tape is consumed, the tape carrier is disposed of and replaced. In another conventional approach, a sticky removal member in the form of a sticky roller riding in contact with the surface of the tacky cleaning platen roller is used to clean the platen roller. When the sticky roller loses its effectiveness it is disposed of and replaced.

Thus, in conventional substrate printers, both the sticky-removal member and the ribbon cartridge must be separately removed and individually replaced. It has been found, however, that most end users neglect to change the sticky removal member when it loses its debris-lifting effectiveness. As a result, debris remaining on the substrate surface can enter the print mechanism causing poor print quality and ultimately leading to the destruction of the printhead that is the most expensive component of the printer.

As noted above, such substrate printers may interface with the components of a replaceable cartridge. As a result, it is important that the interfacing components of a cartridge be accurately positioned with respect to the interfacing components of the printer. Also, in order to aid in the accurate positioning of the interfacing components, it is important that a cartridge be self-locating so that additional positioning by a user is not necessary. In this manner the printer will not suffer performance deficiencies during the life of the printer, a life in which the printer may receive several replaceable cartridges of the same design. Thus, there is a need for a replaceable cartridge design that is self-locating and that provides accurate positioning of interfacing components of the cartridge with respect to those of a printer.

BRIEF SUMMARY OF THE INVENTION

The present invention meets the above needs and achieves other advantages by providing a ribbon cartridge for a printer. In various embodiments, the ribbon cartridge includes a frame that supports supply and take-up spools and includes one or more locating features to facilitate its insertion and positioning in a frame of a printer. For example, the ribbon cartridge frame may include a pair of detents defined approximately midway between the two spools to facilitate balanced insertion. The detents may be slots with rounded ends that are configured to receive similarly shaped reference protrusions of the printer frame. Motion of the ribbon cartridge may be further mediated by surfaces of the ribbon cartridge frame that abut support pads of the printer frame and support biased springs that extend from a closed cover of the printer. The cartridge frame may also define a pocket for receiving an identification tag associated with the ribbon cartridge that ensures compatibility with the printer and passage of other information to the printer.

In one embodiment, the present invention includes a ribbon cartridge that includes a cartridge frame, a supply spool located at a supply spool retaining end of the cartridge frame, and a take-up spool located at a take-up spool retaining end of the cartridge frame. The cartridge frame supports the supply and take-up spools in a spaced apart relationship wherein a ribbon extends from the supply spool, onto the take-up spool. The ribbon cartridge may be supported in a printer.

The cartridge frame preferably includes one or more locating features that facilitate insertion of the ribbon cartridge into a printer. For example, the cartridge frame may define one or more detents that are shaped to receive corresponding reference protrusions extending from a printer frame. These detents may have a rounded portion and may be positioned approximately midway between the spools so as to facilitate a smooth, balanced insertion.

Further, on opposite sides of the detents may be support surfaces that are configured to abut support pads positioned or the printer frame that are located on opposite sides of the reference protrusions. The ribbon cartridge frame can also include one or more bias support features that may be surfaces oriented to receive pressure exerted by similarly placed biased pins extending from a closed cover of the printer.

A cleaning roller may be connected to the frame of the ribbon cartridge by one or more springs. For example, the ribbon cartridge may include a pair of cantilevered springs that are attached on one end to the cartridge frame and extend outward to another end to support ends of the cleaning member. For the roller-type cleaning member, the ends of the cantilever springs may include a pair of cleaning roller supports configured to rotatably support ends of the cleaning member. To provide clearance for deflection of the cleaning roller, the ribbon cartridge may define a pair of cantilever cutouts in its sidewalls. Advantageously, this provides for easy assembly of the cleaning roller and the cartridge frame at the time of its manufacture.

In another aspect, the ribbon cartridge may include a smart card chip that is supported within a pocket or recess defined on the cartridge frame. For example, a tag pocket may be defined in an end of an enclosure for one of the spools. The tag pocket can be defined by a tag flange that fits between top and bottom portions of the spool enclosure and may include a perimeter wall that protectively surrounds at least edges, and even portions of the front of the smart card chip.

The present invention includes many advantages. For example, the various locating features, such as the rounded detent with its positioning between the spools, provides for easy, balanced insertion into the printer. The tag pocket provides for more secure positioning of somewhat delicate smart card chips.

BRIEF DESCRIPTION OF THE DRAWINGS

The objects, features and advantages of the invention will be evident to those skilled in the art from the detailed description below, taken together with the accompanying drawings, in which:

FIG. 2 is an enlarged side elevation view of a portion of a cleaning station of the printer of FIG. 1;

FIG. 3 is an end elevation view, in cross section, of a portion of the cleaning station of the printer as seen along the line 3-3 in FIG. 1;

FIG. 4 is a side elevation view of a ribbon cartridge of another embodiment of the present invention;

FIG. 5 is a perspective view of the ribbon cartridge of FIG. 4;

FIG. 6 is a side elevation view of a portion of a substrate cleaning station in accordance with another embodiment of the present invention;

FIG. 7 is a side elevation view of a portion of a substrate cleaning station in accordance with another embodiment of the invention;

FIG. 8 is a side elevation view of a portion of a substrate cleaning station in accordance with another embodiment of the invention;

DETAILED DESCRIPTION OF THE INVENTION

The present invention now will be described more fully hereinafter with reference to the accompanying drawings, in which some, but not all embodiments of the invention are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

Figure 1:
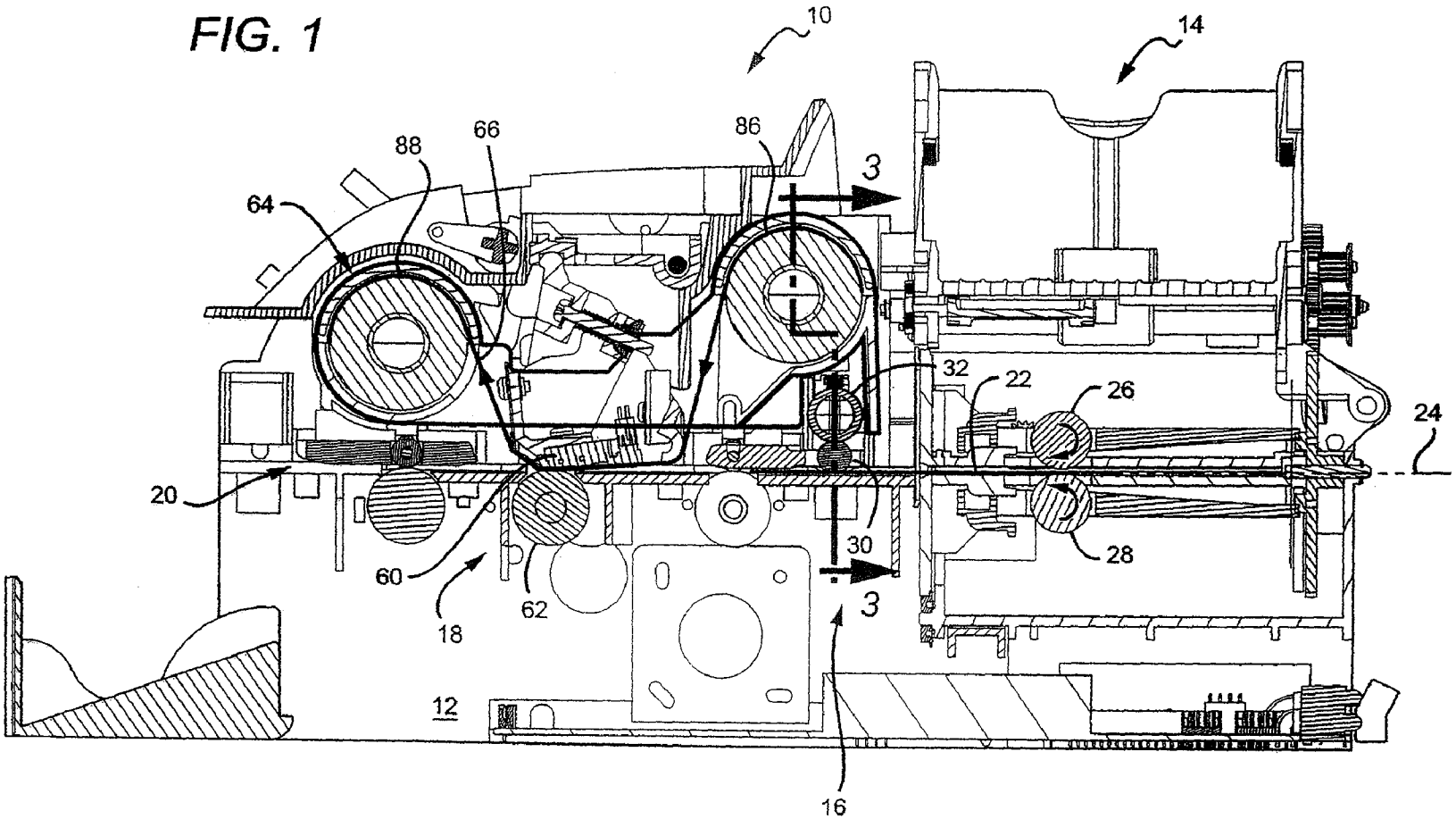
FIG. 1 is a side elevation view, partly in cross section, of a portion of a thermal transfer substrate printer incorporating one specific, exemplary embodiment of the present invention.

With reference to FIG. 1, there is shown a portion of a thermal transfer printer 10 incorporating a specific, exemplary embodiment of the present invention. As is known, thermal transfer printers are typically used to print information in the form of text, graphics, photographs, and so forth, on plastic cards such as I.D. cards, drivers' licenses, and the like using a printer consumable such as a thermal transfer or dye sublimation ribbon-carried by a disposable ribbon cartridge. It will be evident to those skilled in the art that the present invention has broader utility, being applicable to a wide variety of information-receiving media including substrates of paper or cardboard. Thus, it will be understood that the context in which the present invention is described in detail is exemplary only and is not intended to be limiting of the scope of the invention.

The thermal transfer substrate printer 10 generally comprises a printer body or frame 12, a substrate supply and feeder station 14, a substrate cleaning station 16, a substrate print station 18 and a substrate discharge station 20. Individual substrates 22 are transported in succession from right to left, as viewed in FIG. 1, along a substantially horizontal substrate feed path 24 between the substrate supply and feeder station 14 and the discharge station 20.

The substrate supply and feeder station 14 is conventional and need not be described in detail. Suffice it to say that the substrate supply and feeder station 14 includes a pair of opposed, counter-rotating substrate drive rollers 26 and 28 for transporting individual substrates along the substrate feed path 24 toward the substrate cleaning station 16.

With reference now also to FIGS. 2 and 3, the substrate cleaning station 16 comprises the stacked combination of a first cleaning member 30 and a second cleaning member 32 above the first member 30. The first cleaning member 30 is typically in the form of a roller having end shafts 34 cradled for rotation within vertical slots 36 formed in opposed printer frame side members 38. The cleaning roller 30 is thereby vertically displaceable relative to the printer frame 12 in response to the presence of the substrates and to accommodate variations in substrate thickness. At the substrate cleaning station 16, each substrate 22 passes under the first or primary cleaning roller 30 in contact with an outer surface 44 thereof. The surface 44 of the first cleaning roller 30 is tacky so that it lifts any debris from the print-receiving surface of each substrate. By way of example, the surface 44 may comprise silicone that has been treated in well-known fashion to make the surface tacky to cause debris to be lifted from the print-receiving substrate surface. The second cleaning roller 32 has an outer sticky surface 46 that rides in contact with the outer tacky surface 44 of the first cleaning roller 30 to remove other debris from the tacky outer surface 44 of the first cleaning roller. For this purpose, the sticking power of the sticky surface 46 of the second cleaning roller 32 is greater than that of the tacky outer surface 44 of the first cleaning roller 30. The sticky surface 46 of the second roller 32 may be provided by covering the roller with a suitably treated coating or layer 47 that may simply comprise double-sided masking tape. (FIGS. 2 and 3). Preferably, the diameter of the second cleaning roller 32 is greater than that of the first cleaning roller 30 so that the effective cleaning surface area of the second roller is greater than that of the first roller and thus can retain a concomitantly greater amount of debris. Preferably, the circumference of the first roller 30 is equal to the length of one of the substrates or cards being processed. Also preferably, the region 48 of engagement between the first and second cleaning rollers is diametrically opposite the region 50 of engagement between the first cleaning roller and the print-receiving surface 51 of the substrate 22 fed along the substrate feed path 24. It will be evident that other positional relationships between the rollers 30 and 32 are possible so long as the second cleaning roller is disposed in contact with the first cleaning roller to effectively remove debris therefrom. It will also be seen that the respective axes of rotation 52 and 54 of the first and second rollers 30 and 32 are parallel and oriented transversely, that is, perpendicular to the direction of the substrate feed path 24.

Referring again to FIG. 1, the substrate print station 18 may comprise a conventional thermal printhead 60, a printing platen roller 62, and a cartridge 64 containing a printer consumable comprising a transfer medium 66 typically in the form of a conventional thermal transfer or dye sublimation ribbon.

Referring now also to FIGS. 4 and 5, a ribbon cartridge 64 in accordance with one embodiment of the present invention is a molded plastic structure comprising a frame 68 including a pair of parallel, spaced-apart, longitudinally oriented support plates 70 and 72.

In the depicted embodiment, the support plates 70, 72 are molded integrally with the bottom portions 74 and 76 of a pair of spaced-apart, transversely oriented cylindrical spool enclosures 78 and 80, respectively. The enclosures 78 and 80 include top portions 82 and 84, respectively, releasably attached to the bottom enclosure portions 74 and 76 by compressible snaps 85. When the top portions 82 and 84 of the enclosures are removed, access is gained to ribbon supply and take-up spools 86 and 88, respectively (FIG. 1). The ribbon supply spool 86, which is located at a supply spool retaining end of the cartridge frame, defines a central ribbon supply axis 87, and the ribbon take-up spool 88, which is located at a take-up spool retaining end of the cartridge frame, defines a central ribbon take-up axis 89.

Referring to FIG. 5, the ribbon supply spool 86 further defines a supply spool end 415 having a supply spool gear 416 positioned proximate the supply spool end 415. Likewise, the take-up spool 88 defines a take-up spool end 417 having a take-up spool gear 418 positioned proximate the take-up spool end 417. As a result, when the cartridge 64 is installed in the printer 10 (as shown, for example, in FIG. 1) the ribbon 66 is fed from the ribbon supply spool 86, between the printhead 60 and the printing platen roller 62 and from there to the take-up ribbon spool 88. In addition, the substrate feed path 24 extends between the thermal transfer ribbon 66 and the printing platen roller 62.

In accordance with another embodiment of the present invention, a second cleaning structure or member in the form of roller 32 that comprises part of the cleaning station 16 is mounted on the ribbon cartridge 64. The second cleaning roller 32 defines a central cleaning roller axis 95. The second cleaning roller 32 is rotatable about outer end shafts 98 and 100 journaled in corresponding bearings 102 and 104 carried by the cartridge frame 68. The shaft bearings 102 and 104 are movable vertically within bearing housings 106 and 108 formed integrally with the cartridge frame 68. The bearings 102 and 104 within which the outer ends of the second cleaning roller shafts 98, 100 are journaled are resiliently biased downwardly (as viewed in FIGS. 1-3) to urge the outer sticky surface 46 of the second cleaning roller 32 into engagement with the outer tacky surface 44 of the first or primary cleaning roller 30 when the cartridge is installed in the printer. It should be noted that although various embodiments of the present invention depict cartridges having integrated cleaning rollers, various other embodiments of the cartridge need not include a cleaning roller, and still others may include a cleaning roller that is separate from the cartridge.

The resilient bias of the second cleaning roller is preferably provided by vertical compression springs 110 and 112 captured between upper, fixed spring retainers 114 and 116, respectively, and the corresponding shaft bearings 102 and 104. It will be evident that other resilient biasing means, for example, elastomeric inserts, may be used. The projecting end shafts 34 of the first cleaning roller 30 are pushed down into the slots 36 by the resilient force imposed on the second cleaning roller 32 by the resilient biasing means. Guided by the slots 36, the first cleaning roller 30 is free to move upwardly in response to the substrates 22 passing underneath, the amount of the upward movement of the roller 30 varying with substrate thickness.

FIG. 6 shows a portion of a substrate printer cleaning station 16a in accordance with a specific, exemplary alternative embodiment of the invention. This embodiment is similar to the cleaning station 16 shown in FIGS. 1 and 2; however, in the embodiment of FIG. 6, the primary cleaning roller 30 on the printer frame has been eliminated and a cleaning structure comprising a roller 32*a*, carried by the ribbon cartridge frame 68 of a replaceable ribbon cartridge, is positioned so that the outer surface 46*a* of the roller 32*a* comes into direct contact with the print-receiving surface 51 of each substrate 22. The outer surface 46*a* of the roller 32*a* may comprise the surface of a tacky or sticky coating or layer 47*a* (such as double-sided masking tape) on the roller 32*a* so that as each substrate 22 is advanced along the feed path 24, any other debris will be lifted from the card surface 51. As before, the useful lives of the cleaning roller 32a and the consumable transfer ribbon are preferably commensurate so that both of these elements will be spent when the ribbon cartridge is replaced.

FIG. 7 shows a portion of a substrate printer cleaning station 16*b* in accordance with another specific, exemplary, alternative embodiment of the invention. The cleaning station 16*b* comprises a substrate cleaning structure including a pair of vertically spaced-apart upper and lower, transverse rollers 120 and 122, respectively, journaled for rotation on the frame 68 of a replaceable ribbon cartridge. The substrate cleaning structure further includes a web or belt 124 having a tacky or sticky outer surface 126, the belt 124 being trained around the rollers 120 and 122. When the ribbon cartridge is installed in a printer, the tacky or sticky outer surface 126 of the belt 124 is positioned to directly contact the print-receiving surface 51 of each substrate 22 and to thereby lift any debris from the substrate surface 51 while the belt is driven in the direction shown by the arrows by the moving substrate. As before, the transfer medium cartridge and cleaning structure carried thereby are disposed of and replaced as a unit, with the useful lives of the transfer medium or ribbon and the cleaning structure being preferably made to be commensurate.

FIG. 8 shows a portion of a substrate printer cleaning station 16*c* in accordance with yet another specific, exemplary embodiment of the invention. The cleaning station 16*c* is similar to the cleaning station 16 of the first embodiment in that it includes a tacky primary cleaning roller 30 that is carried by the printer frame side members 38 and that rides in contact with and removes any debris from the print-receiving surface 51 of each substrate 22 as the substrate is transported along the feed path 24. The cleaning station 16*c* further comprises a substrate cleaning structure in the form of a sticky web or belt 130 trained about a pair of spaced-apart, upper and lower rollers 132 and 134 journaled for rotation on the frame 68 of a replaceable ribbon cartridge. The lower extremity of the sticky belt 130 contacts the surface of the tacky roller 30 to remove any debris therefrom, analogous to the action of the sticky roller 32 of the first embodiment. Disposal and replacement of the ribbon cartridge simultaneously disposes of and replaces the sticky belt 130 carried by the cartridge.

In another exemplary embodiment of the present invention, the ribbon cartridge 64 includes locating features with shapes and positions that facilitate insertion and placement of the ribbon cartridge 64 into a printer frame 12. Advantageously, this allows for easy replacement of the ribbon cartridge 64 and, may be combined with the integrated replacement of a cleaning station 16. Thus providing an incentive for the user to minimize dirt and debris that adversely affect operation of a printer 10 by timely replacement of the ribbon cartridge. The term "locating feature" as used herein describes structure that is configured to register a correct position upon insertion of the ribbon cartridge 64 or that facilitates correct relative positioning of the ribbon cartridge during operation of the printer 10. Correct positioning is generally desired due to the need for repeatable positioning of the ribbon transfer medium 66 with respect to the thermal print head 60 and for a robust connection between driving elements of the printer 10 and the spools 86, 88.

For example, each of the support plates 70 and 72 may include one or more locating features. In particular, the support plates 70 and 72 may include recessed detent locating features 75, as shown in FIGS. 4 and 5. Each of the locating features 75 is a slot defined in the support plate so as to have a rounded profile that may be configured to receive complementary shaped locating features on the printer frame 12, as will be described in more detail below. For instance, a diameter of the locating features 75 with respect to centers 77 of the locating features 75 may be between about 0.08 and 0.10 inches, and is preferably about 0.092 inches to allow for relatively quick but firm positioning during mating with the printer frame 12. Preferably, the locating features 75 are also positioned so as to have the centers 77 co-linear to the locating features 75 serve as reference points or datum for strategically positioning of the ribbon cartridge 64 and its other components to promote balanced insertion of the ribbon cartridge into the printer frame 12. It should be noted that in other embodiments, the ends may have other shapes configured to receive locating features, included v-shaped ends, and the like. Extending laterally outward from a locating feature 75 may also be an additional locating feature 420 that is a generally elongate, flat surface positioned to abut a surface or surfaces of the printer frame 12.

In another example, the support plates 70 and 72 also include a plurality of bias support features 99 that provide a support for biasing mechanisms of the printer 10 with locating feature functionality. For example, the bias support features 99 may be planar surfaces upon which a force is exerted in order to stabilize the cartridge 64 once inside the printer 10, as shown in FIGS. 4 and 5. The bias support features 99 are generally flat, narrow ledges defined at specific locations along edges of the support plates 70, 72. As mentioned above, the particularized shape and location of the locating features facilitates insertion of the ribbon cartridge 64 into the printer frame 12 which has its own locating features.

Figure 9:
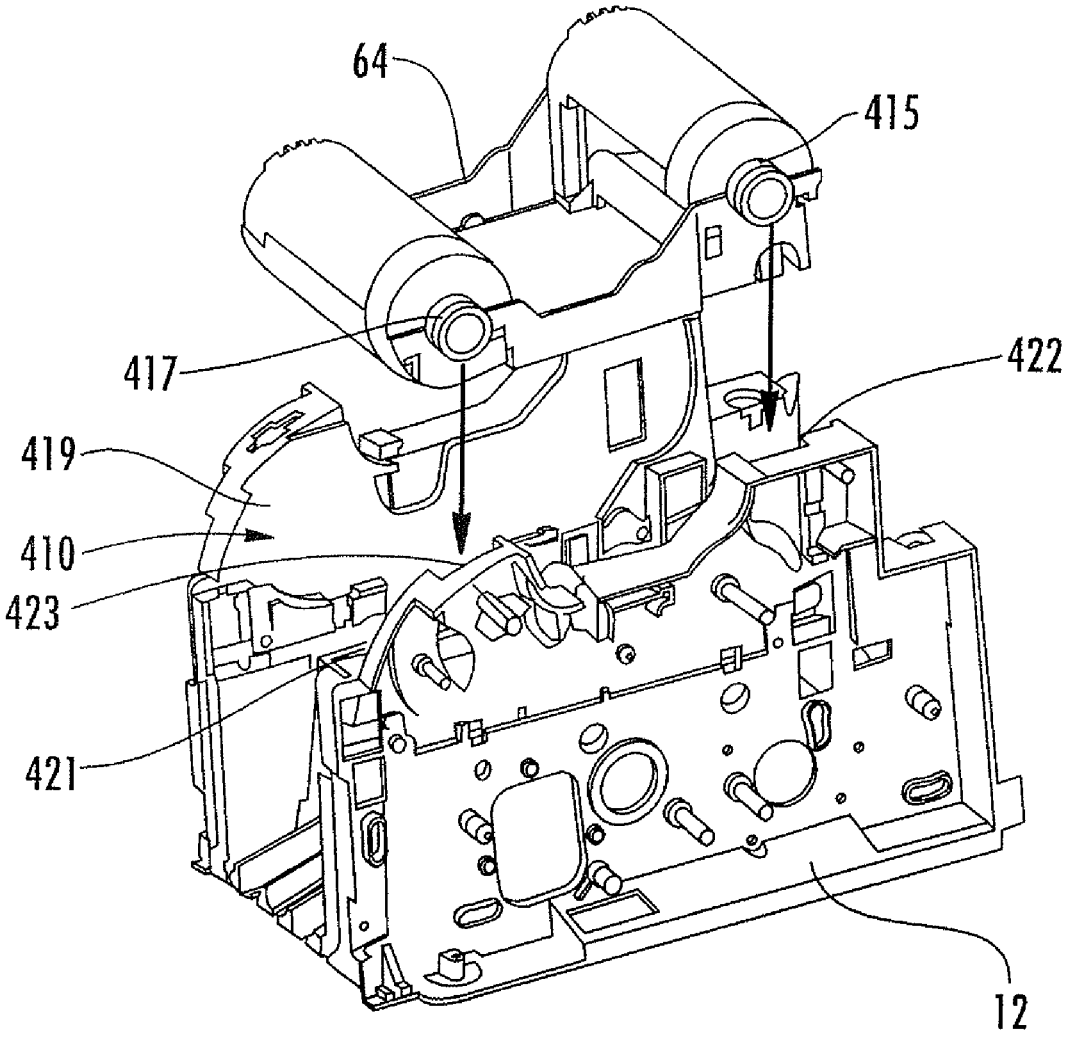
FIG. 9 is a perspective view of a ribbon cartridge in accordance with another embodiment of the present invention, wherein the ribbon cartridge is positioned to be inserted into a printer frame.

FIG. 9, for example, shows the ribbon cartridge 64 being inserted into a printer frame 12. The printer frame 12 includes a first cartridge side wall 419 and a second cartridge side wall 421 that together define a cartridge slot 410, which is configured to receive and guide the width of the ribbon cartridge 64. In addition, the second cartridge side wall 421 includes a supply spool slot 422 and a take-up spool slot 423 which are configured to slidably receive the width of the supply and takeup spool ends 415, 417. As indicated by the arrows in FIG. 9, in order to position the cartridge 64 into the printer 10, the supply spool end 415 is inserted downward into a supply spool slot 422. Likewise, the take-up spool end 417 is inserted downward into a take-up spool slot 423. The printer frame also includes a pair of reference protrusions 412 located in the cartridge slot 410 that are sized and shaped to insert into the locating features 75 and a pair of additional support pads 414, as shown in FIG. 10.

Figure 10:
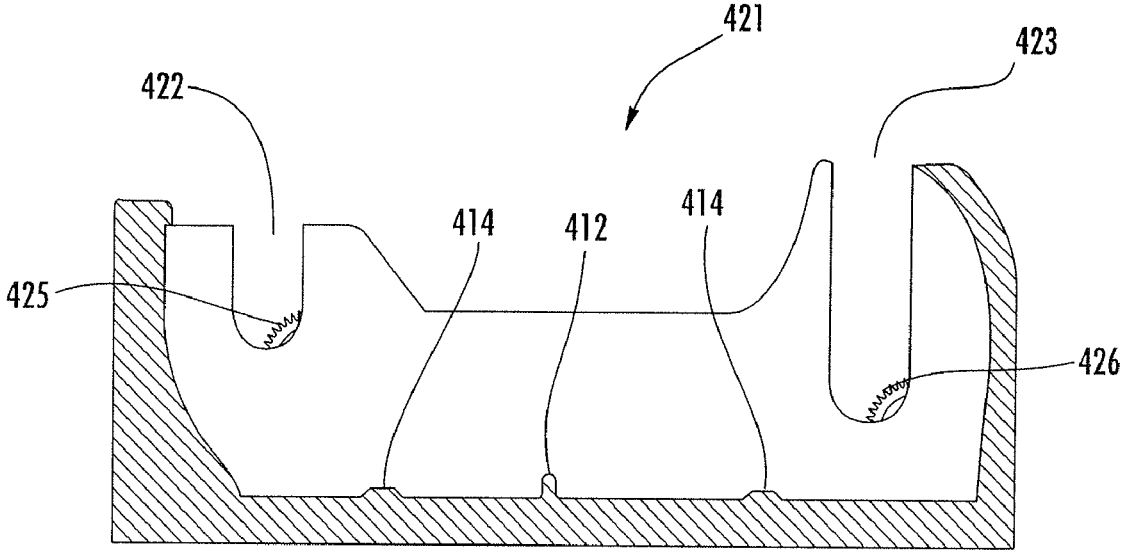
FIG. 10 is a partial cross-sectional view of one side of the printer frame of FIG. 9 showing a cartridge slot.

FIG. 10 shows a partial cross-sectional view of the second cartridge side wall 421 showing the supply spool slot 422 and the take-up spool slot 423. A supply drive gear 425 of the printer 10 is located behind the supply spool slot 422 such that it is positioned to mesh with the supply spool gear 416 when the cartridge 64 is positioned on the reference protrusions 412 and the support pads 414. The printer 10 may also include a take-up spool gear 426 that is located behind the take-up spool slot 423 such that it is positioned to mesh with the take-up spool gear 418 when the cartridge 64 is positioned on the reference protrusions 412 and the support pads 414.

Figure 11:
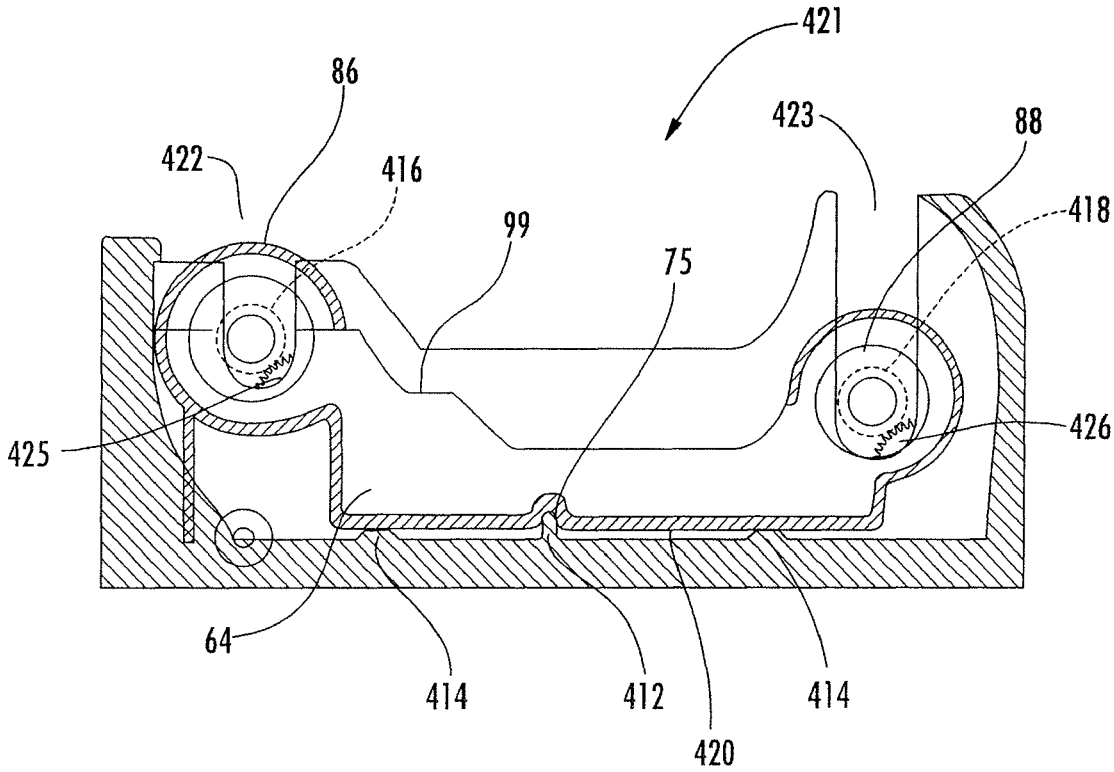
FIG. 11 is a partial cross-sectional view of the printer frame of FIG. 9 with the ribbon cartridge of FIG. 9 positioned in the cartridge slot.

FIG. 11 is a partial cross-section view showing the cartridge placed into the cartridge slot 410. The reference protrusions 412 and the support pads 414 provide lateral and vertical references in order to locate the cartridge 64 accurately relative to the interfacing components of the printer 10. Notably, the reference protrusions 412 extend into the locating features 75 and, due to the rounded surfaces of both and the central positioning of the locating features, serve as a pivot point for the ribbon cartridge 64 (facilitating easy insertion thereof) while the support pads 414 mediate the pivot for accurate positioning.

Figure 12:
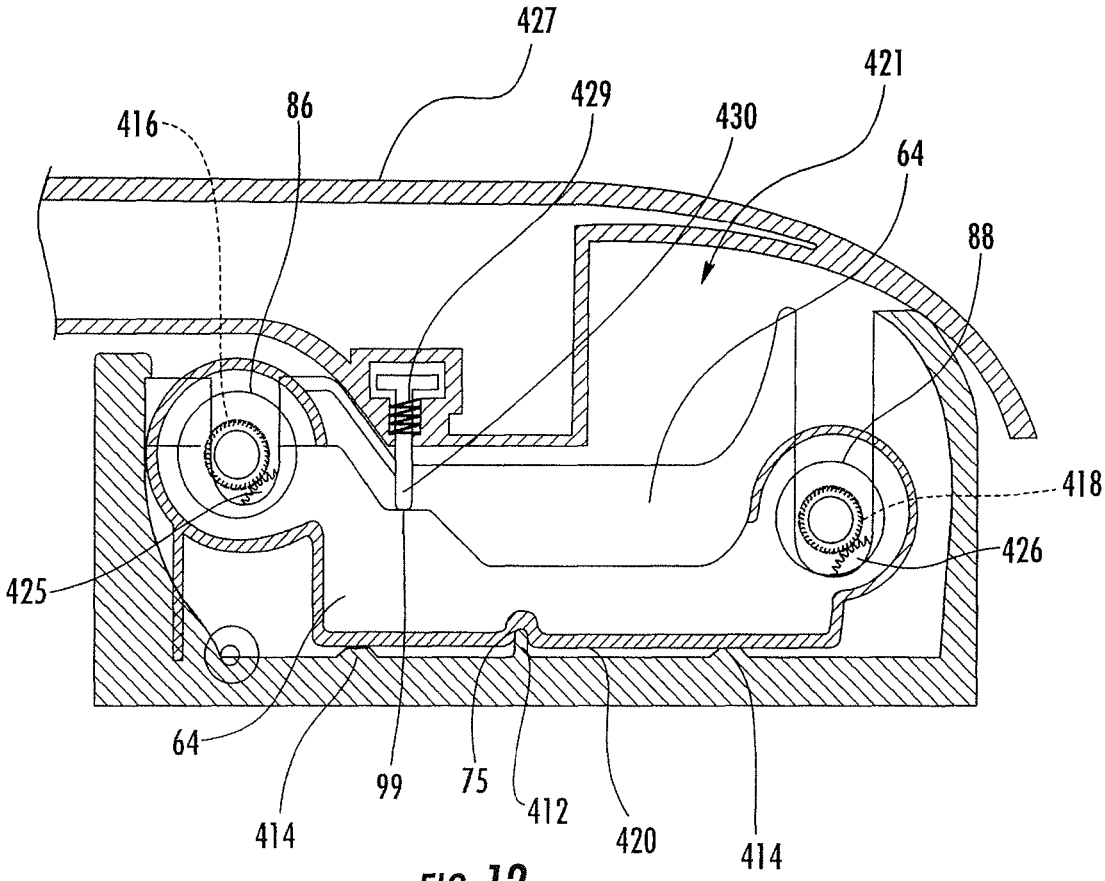
FIG. 12 is a partial cross-sectional view of the printer frame of FIG. 9 with the ribbon cartridge of FIG. 9 positioned in the cartridge slot and with a printer cover in a closed position.

FIG. 12 is a partial cross-section view showing the cartridge 64 placed inside the cartridge slot 410 with a printer cover 427 of the printer 10 covering the cartridge slot 410. The printer cover 427 pivots between an open position, in which the cartridge 64 may be inserted or removed from the cartridge slot 410, and a closed position, in which the printer cover 427 interfaces with the cartridge 64 into order to further stabilize the cartridge 64 into the cartridge slot 410. FIG. 12 shows the printer cover 427 in the closed position.

In order to stabilize the cartridge 64 in its seated position, the printer cover 427 includes a pair of bias pins 430 that provide a vertical force against the cartridge 64 via bias springs 429. As shown in FIG. 12, when the printer cover 427 is in the closed position, the bias pins 430 contact the cartridge 64 at the bias support features 99. The bias pins 430 create a downward force, pushing the cartridge 64 against the support pads 414 in order to locate the cartridge 64 vertically and stabilize the cartridge 64 for operation. So positioned, the supply spool gear 416 and the take-up spool gear 418 are positioned to mesh with the supply drive gear 425 and the take-up drive gear 426, respectively.

As shown in FIG. 4, and as demonstrated by comparing distance 9 to distance 5, in one embodiment of the present invention, locating features 75 are positioned near to the mid-point between the ribbon supply spool 86 and the ribbon take-up spool 88. The locating features 75 and the reference protrusions 412 (shown in FIG. 10) have a rounded profile. As a result of their position and profile, the locating features 75 perform a balancing and centering function that helps to self-locate the cartridge 64. As shown in FIG. 9, a cartridge 64 is installed into the printer 10 by placing the cartridge 64 into the cartridge slot 410, aligning the supply spool end 415 with the supply spool slot 422 and the take-up spool end 417 with the take-up spool slot 423. As the cartridge is lowered into the cartridge slot 410, the weights of the portions of the cartridge carrying the ribbon supply spool 86 and ribbon take-up spool 88 counter-balance each other about the locating features 75. When the cartridge 64 reaches the reference protrusions 412, the rounded profile of the locating features 75 and reference protrusions 412 then guide the cartridge 64 into an operational position. As shown in FIG. 12, in the operational position, the locating features 75 mate with the reference protrusions 412 and the cartridge locating features 420 contact the support pads 414. If, for example, the cartridge 64 is inserted into the cartridge slot 410 with the ribbon supply spool 86 portion slightly lower than the ribbon take-up spool 88 portion, the weight of the ribbon take-up spool 88 portion will generally counter the weight of the ribbon supply spool 88 portion about the rounded reference protrusion features 412 such that the cartridge 64 will fall naturally into its operational position wherein the interfacing components of the cartridge 64 are accurately positioned with respect to mating components of the printer.

As noted above, the interfacing components of the cartridge 64 are dimensioned from common locating features 75. In the embodiment depicted in FIG. 4, the ribbon supply spool 86 defines the central ribbon supply axis 87, that is located a distance 5 from centers 77 of the locating features 75 along an axis substantially parallel to a horizontal first reference axis 1 as shown in the feature. In the depicted embodiment, distance 5 is between about 1.68 and 2.28 inches, and is preferably about 1.983 inches. Likewise, the ribbon supply axis 87 is located a distance 7 from centers 77 of the locating features 75 along an axis substantially parallel to a vertical second reference axis 2. In the depicted embodiment, distance 7 is between about 1.00 and 1.6 inches, and is preferably about 1.305 inches.

The ribbon take-up spool 88 also defines the central ribbon take-up axis 89, that is located a distance 9 from centers 77 of locating features 75 along an axis substantially parallel to the horizontal first reference axis 1. In the depicted embodiment, distance 9 is between about 1.8 and 2.4 inches, and is preferably about 2.10 inches. Likewise, the ribbon take-up axis 89 is located a distance 11 from centers 77 of the locating features 75 along an axis substantially parallel to the vertical second reference axis 2. In the depicted embodiment, the distance 11 is between about 0.46 and 1.06 inches, and is preferably about 0.765 inches.

The cleaning roller 32 also defines a central cleaning roller axis 95, that is located a distance 17 from centers 77 of locating feature 75 along an axis substantially parallel to the horizontal first reference axis 1. In the depicted embodiment, distance 17 is between about 2.01 and 2.70 inches, and is preferably about 2.398 inches. Likewise, the cleaning roller axis 95 is located a distance 19 from centers 77 of locating feature 75 along an axis substantially parallel to the vertical second reference axis 2. In the depicted embodiment, the distance 19 is between about 0 and 0.35 inches, and is preferably about 0.046 inches.

As also shown in the figure, additional locating features 420 are located a distance 439 from centers 77 of locating feature 75 along an axis substantially parallel to the vertical second reference axis 2. In the depicted embodiment, distance 439 is between about 0 and 0.24 inches and is preferably about 0.06 inches. Additionally, bias support feature 99 is located a distance 21 from centers 77 of locating features 75 along an axis substantially parallel to the vertical second reference axis 2. In the depicted embodiment, distance 21 is between about 0.46 and 1.06 and is preferably about 0.765 inches.

In the past, the disposable ribbon cartridge and the disposable sticky cleaning member needed to be changed individually. End users, however, often neglected to change the sticky cleaning member when due for replacement. This allowed debris to remain on the substrate surface and foul the print mechanism. In some embodiments, the ribbon cartridge and the sticky cleaning structure such as the sticky roller 32 may be integrated, in a single unit, such that only that one part needs to be replaced. A sticky cleaning member is typically discarded after a predetermined number of substrates, for example, about two hundred, have passed through the printer. It happens that this replacement cycle is substantially the same as the replacement cycle of the ribbon so that both will be spent at about the same time.

Figure 13:
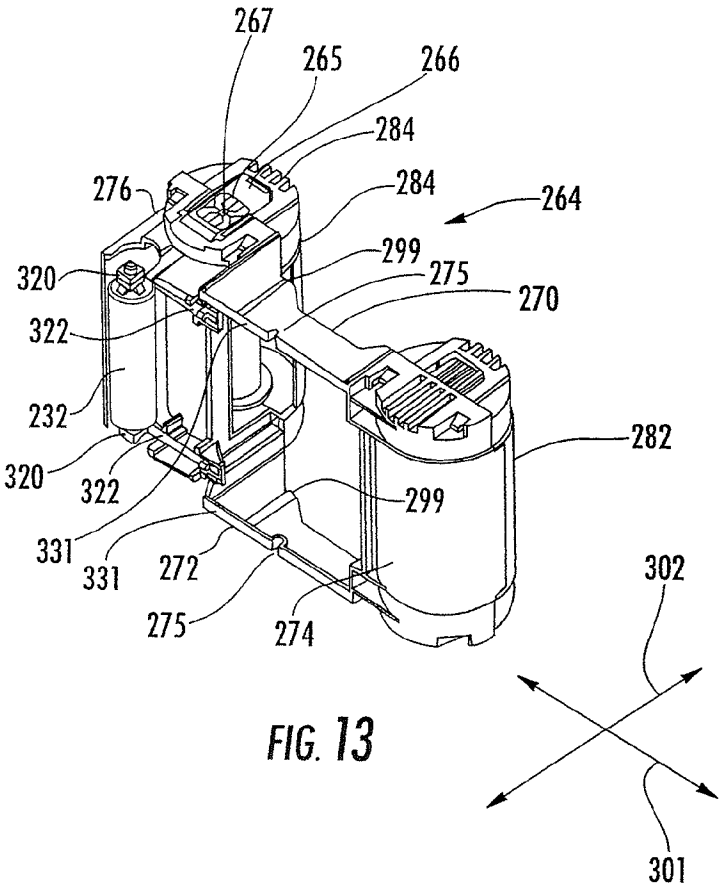
FIG. 13 is a perspective view of a ribbon cartridge in accordance with another embodiment of the present invention.
Figure 13A:
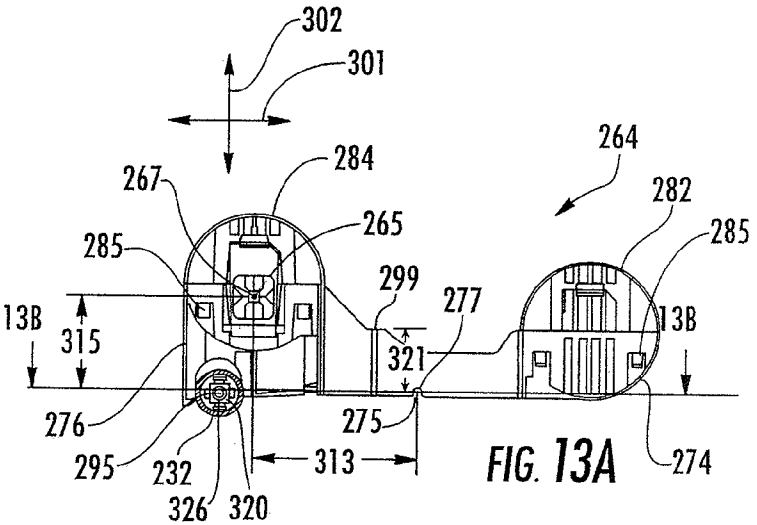
FIG. 13A is a side elevation view of the ribbon cartridge of FIG. 13.
Figure 13B:
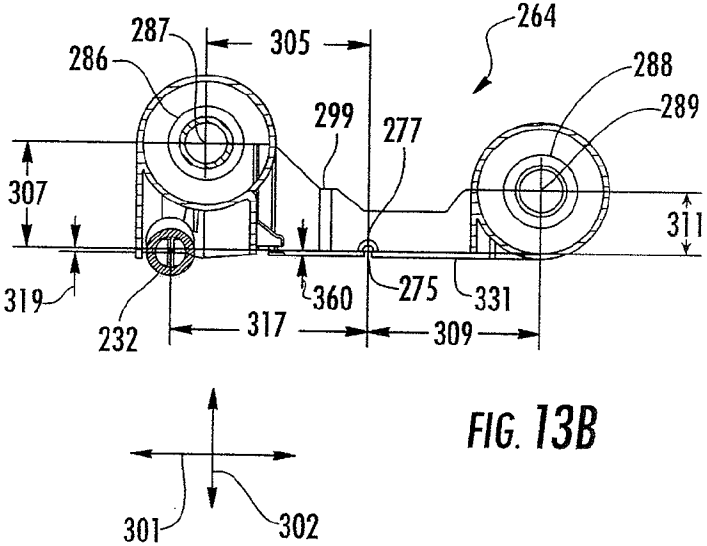
FIG. 13B is a cross-sectional view of the ribbon cartridge of FIG. 13.

Referring to FIGS. 13-13B, another embodiment of the present invention includes a ribbon cartridge 264 comprising a frame 268 including a pair of longitudinally oriented support plates 270 and 272. The ribbon cartridge 264 defines a horizontal first reference axis 301, and a vertical second reference axis 302 that is substantially perpendicular to the horizontal first reference axis 301. The support plates 270 and 272 include at least one locating feature 275 for accurately positioning the cartridge 264 inside a printer. In the depicted embodiment, each of the support plates 270 and 272 includes a locating feature 275. The locating features 275 are groove-like features having a rounded profile that receive mating reference protrusions such as reference protrusions 412 depicted in FIGS. 10-12. The locating features 275 define centers 277 that serve as the reference or datum of the cartridge. The centers 277 define a diameter of the locating feature 275 that is between about 0.08 and 0.10 inches, and is preferably about 0.092 inches. As will be discussed below, interfacing components of the cartridge are dimensioned from the reference features in order to accurately position these components with respect to the corresponding interfacing components of the printer. The support plates 270 and 272 also include bias support features 299. The bias support features 299 define planar surfaces upon which bias pins, such as bias pin 430 depicted in FIG. 12, exert a force when the printer cover is closed. This serves to maintain contact between additional cartridge locating features 331 and a set of support pads such as support pads 414 depicted in FIG. 12.

The cartridge frame 268 also includes top portions 282 and 284 that are releasably attached to bottom enclosure portions 274 and 276, respectively, by attachment features 285. In the depicted embodiment, an identification tag 265 defining a center 267 is located on the cartridge frame 268, inside a tag pocket 266 as shown in FIGS. 13 and 13B. The identification tag 265 is preferably a smart card chip, however the identification tag 265 may be any type of identification tag such as a Radio Frequency Identification (RFID) tag, an Electronic Article Surveillance (EAS) tag, a magnetic tag, or the like.

When the top portions 282 and 284 of the enclosures are removed, access is gained to ribbon supply and take-up spools 286 and 288, respectively. Ribbon supply spool 286 and ribbon take-up spool 288 are shown in FIG. 13B. The ribbon supply spool 286 defines a central ribbon supply axis 287 and the ribbon take-up spool 288 defines a central ribbon take-up axis 289. A cleaning roller 232 having a cleaning roller shaft 326 that defines a central cleaning roller axis 295 may be mounted on the ribbon cartridge 264.

As noted above, it is advantageous to accurately position the components of the disposable cartridge that interface with components of the printer. In order to accurately interface these components with the printer, each of their locations is dimensioned from the centers 277 of the cartridge locating features 275, which in turn mate with printer reference protrusions such as reference protrusions 412 shown in FIGS. 10-12.

As noted above, the identification tag 265 defines a center 267. The center 267 of the identification tag 265 is located a distance 313 from the centers 277 of the locating features 275 along an axis substantially parallel to the horizontal first reference axis 301. In the depicted embodiment, distance 313 is between about 1.68 and 2.28 inches, and is preferably about 1.983 inches. Likewise, the center 267 of the identification tag 265 is located a distance 315 from centers 277 of the locating features 275 along an axis substantially parallel to the vertical second reference axis 302. In the depicted embodiment, distance 315 is between about 0.85 and 1.45 inches, and is preferably about 1.15 inches.

The ribbon supply spool 286 defines a central ribbon supply axis 287 that is located a distance 305 from centers 277 of the locating features 275 along an axis substantially parallel to the horizontal first reference axis 301. In the depicted embodiment, distance 305 is between about 1.68 and 2.28 inches, and is preferably about 1.983 inches. Likewise, the ribbon supply axis 287 is located a distance 307 from centers 277 of the locating features 275 along an axis substantially parallel to the vertical second reference axis 302. In the depicted embodiment, distance 307 is between about 1.00 and 1.6 inches, and is preferably about 1.305 inches.

The ribbon take-up spool 288 also defines a central ribbon take-up axis 289, that is located a distance 309 from centers 277 of locating features 275 along an axis substantially parallel to the horizontal first reference axis 301. In the depicted embodiment, distance 309 is between about 1.8 and 2.4 inches, and is preferably about 2.10 inches. Likewise, the ribbon take-up axis 289 is located a distance 311 from centers 277 of the locating features 275 along an axis substantially parallel to the vertical second reference axis 302. In the depicted embodiment, distance 311 is between about 0.46 and 1.06 inches, and is preferably about 0.765 inches.

The cleaning roller 232 also defines a central cleaning roller axis 295, that is located a distance 317 from centers 277 of locating feature 275 along an axis substantially parallel to the horizontal first reference axis 301. In the depicted embodiment, distance 317 is between about 2.01 and 2.70 inches, and is preferably about 2.398 inches. Likewise, the cleaning roller axis 295 is located a distance 319 from centers 277 of locating features 275 along an axis substantially parallel to the vertical second reference axis 302. In the depicted embodiment, the distance 319 is between about 0 and 0.35 inches, and is preferably about 0.046 inches.

Reference surfaces 331 define a distance 360 from centers 277 of locating features 275 along an axis substantially parallel to second reference axis 302. In the depicted embodiment, distance 360 is between about 0 and 0.24 inches, and is preferably about 0.06 inches. Additionally, bias support features 299 are located a distance 321 from centers 277 of locating features 275 along an axis substantially parallel to the second reference axis 302. In the depicted embodiment, distance 321 is between about 0.46 and 1.06 inches and is preferably about 0.765 inches.

As shown in FIG. 13B, and as demonstrated by comparing distance 309 to distance 317, locating features 275 are positioned near to the mid-point between the ribbon supply 286 and the ribbon take-up 288. As also shown in the figure, the locating features 275 and the reference protrusions 412 (shown in FIG. 10) have a rounded profile. As a result, the position of the locating features 275 and the profile of the locating features 275 together perform a balancing and centering function that helps to self-locate the cartridge 264 inside of the printer. As the cartridge is lowered into the cartridge slot 410, the weight of the portion of the cartridge carrying the ribbon supply 286 and the weight of the portion of the cartridge 264 carrying the ribbon take-up 288, counterbalance each other about the locating features 275. The rounded profile of the reference protrusions 412 then guide the cartridge 264 into an operational position, in which the locating features 275 mate with the reference protrusions 412, as similarly shown in FIG. 12. For example, if the cartridge 264 is inserted into the cartridge slot 410 with the ribbon supply spool 286 portion slightly lower than the ribbon take-up 288 portion, the weight of the ribbon take-up 288 portion will counter the weight of the ribbon supply 288 portion about the rounded reference protrusion features 412 such that the cartridge 264 will fall naturally into its operational position.

Figure 14:
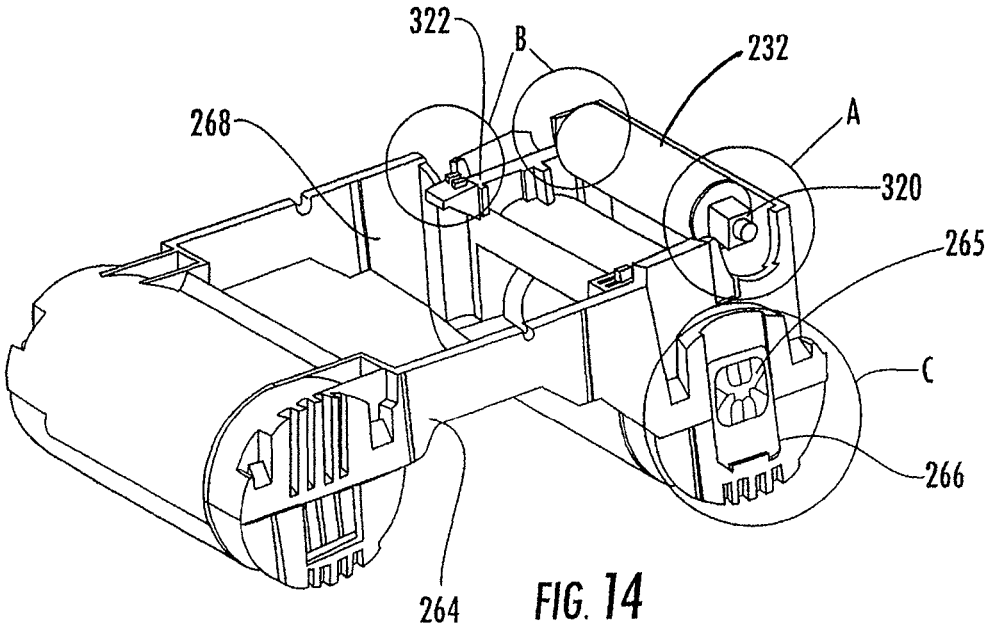
FIG. 14 is a perspective view of the ribbon cartridge of FIG. 13 in an inverted position.

FIG. 14 shows an additional perspective view of the ribbon cartridge 264 in an inverted orientation in order to detail other aspects of the ribbon cartridge 264 of the depicted embodiment. The cleaning roller supports 320 are attached to a pair of cleaning roller springs 322 that are in turn attached to the cartridge frame 268. The cleaning roller springs 322 comprise a pair of elongate flexible members that are mounted to the cartridge frame 268 in a cantilevered configuration such that the cleaning roller 232 may deflect approximately along an axis substantially parallel to the second reference axis 302 of FIG. 13. The cleaning roller springs 322 are preferably made of stainless steel, however they may be made of any flexible material that, when mounted in a cantilevered configuration, provides sufficient resistance against a mating roller, including but not limited to other high carbon metals as well as polymeric materials.

The cartridge frame 268 also defines a pair of cleaning roller cutouts 325. The cleaning roller cutouts 325 aid in the assembly and disassembly of the cartridge by providing access to the cleaning roller 232, the cleaning roller shaft 326, and the cleaning roller supports 320. Additionally, both ends of the cleaning roller 232 are free to deflect independent of each other so as to compensate for any irregularities that may be present in a mating cleaning roller. Because the resilient bias features of this embodiment do not need to be captured, the cantilevered configuration of the cleaning roller 232 aids in assembly. In addition, the cleaning roller springs 322 do not need to be "preloaded" during installation in order to provide a force against a mating cleaning roller.

Figure 14A:
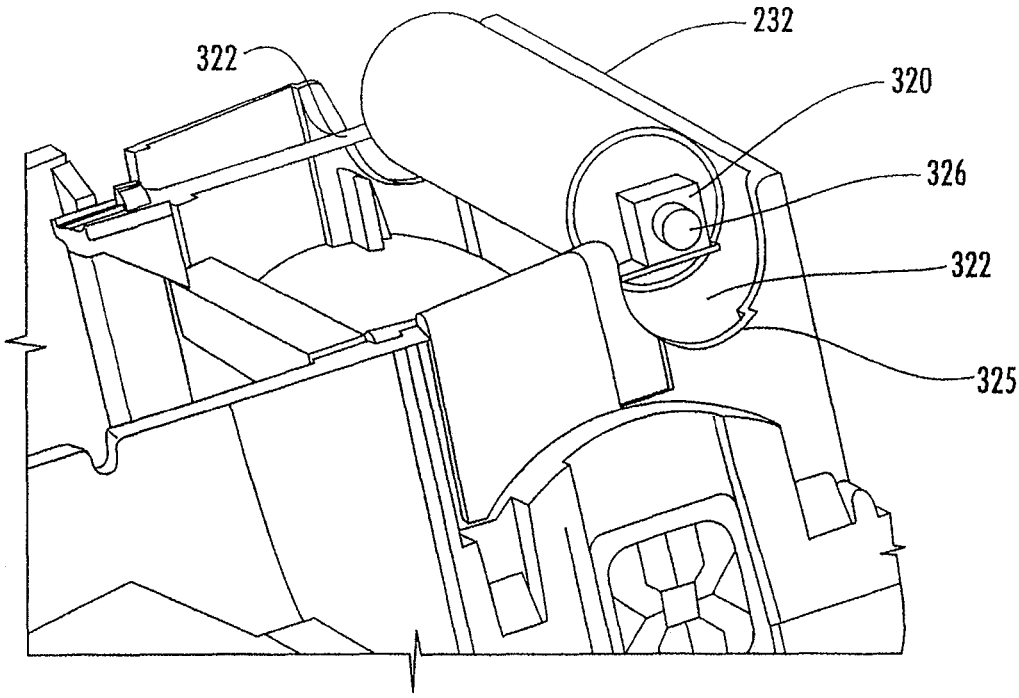
FIG. 14A is an enlarged view of the ribbon cartridge depicted in FIG. 13 showing a cleaning roller.
Figure 14B:
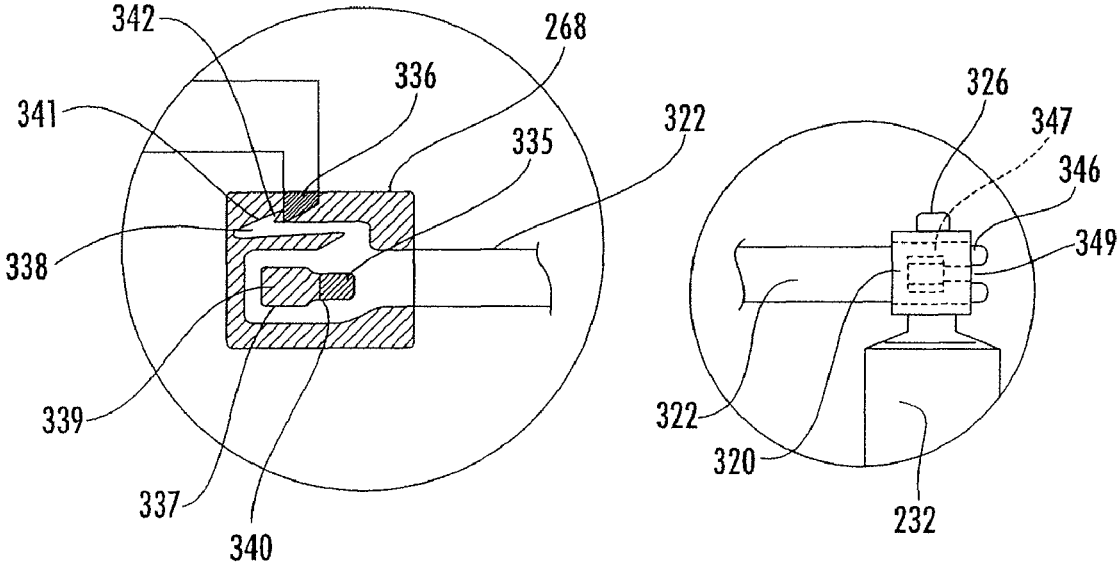
FIG. 14B is an enlarged view of the ribbon cartridge depicted in FIG. 13 showing attachments for cleaning roller springs.

FIG. 14B shows a detailed view of the attachment point between the cleaning roller springs 322 and the cartridge frame 268, as well as the attachment point between the cleaning roller springs 322 and the cleaning roller supports 320. As shown in FIG. 14A, the cleaning roller 232 is rotatably mounted on a cleaning roller shaft 326 that is mounted inside a pair of cleaning roller supports 320. The cleaning roller supports 320 not only provide an attachment point for the cleaning roller springs 322, but also provide a bearing surface for the cleaning roller shaft 326. The cleaning roller supports 320 are preferably made of nylon, however they made be made of any material sufficient to provide an attachment point for the cleaning roller springs 322, and a bearing surface for the cleaning roller shaft 326, such as polytetrafluouroethylene (PTFE) or a phenolic composite material.

Referring to the right portion of FIG. 14B, the cleaning roller spring 322 includes a pair of spring prongs 346 that together define a spring slot 349. The cleaning roller supports 320 include a locking feature 347 that slides between the spring prongs 346 in order to lock the cleaning roller supports 320 onto the cleaning roller springs 322. The cleaning roller axis 326 passes inside a bearing surface within the cleaning roller supports 320 so that the cleaning roller 232 is rotatably mounted by the cleaning roller supports 320.

The attachment point between the cleaning roller spring 322 and the cartridge frame 268 is shown in the left portion of FIG. 14B. The ends of the cleaning roller springs 322 include a key slot 337 and an angled barb feature 338. The key slot 337 has a larger first area 339 that necks down and leads into a smaller second area 340. The angled barb feature 338 includes an angled surface 341 and a pointed end 342, as shown. The attachment portion of the cartridge frame 268 includes a raised key feature 335 and a raised hook feature 336. The larger first area 339 of the key slot 337 is designed to fit easily over the raised key feature 335 of the cartridge frame 268, whereas the smaller second area 340 of the key slot 337 is designed to fit tightly around the raised key feature 335. In order to install the cleaning roller spring 322 onto the cartridge 264, the larger first area 340 of the key slot 337 is placed down and over the raised key feature 335. The cleaning roller spring 322 is then moved into position such that the raised key feature 335 slides into the smaller second area 340 of the cleaning roller spring 322. This enables the barb feature 338 of the cleaning roller spring 322 to slide along the raised hook feature 336 until the pointed end 342 hooks into the raised hook feature 336.

Figure 14C:
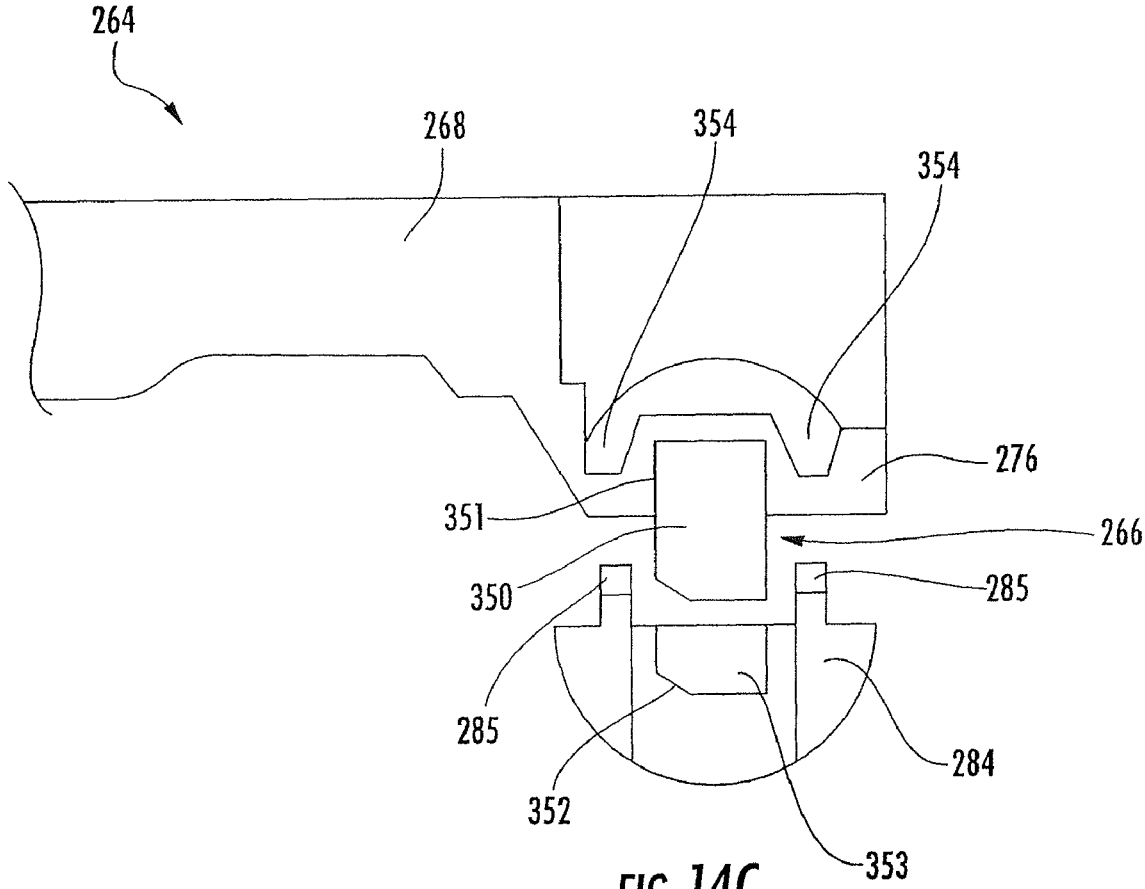
FIG. 14C is an enlarged view of the ribbon cartridge depicted in FIG. 13 showing an identification tag pocket.

FIG. 14C shows a detailed view of an inverted cartridge 264 showing the top portion 284, which has been separated from bottom enclosure portion 276, to highlight the details of the tag pocket 266. In the depicted embodiment, the tag pocket 266 is defined by a tag flange 350, a bottom tag perimeter wall 351, and a top tag perimeter wall 352. The tag flange 350 extends from bottom enclosure portion 276 and serves as the attachment surface for an identification tag 265. The tag flange surface is recessed with respect to adjacent surfaces of the bottom enclosure portion 276, such that the bottom tag perimeter wall 351 surrounds the bottom portion of the tag flange 350. The top portion 284 includes a recessed flange backing surface 353 and a top tag perimeter wall 352. The top tag perimeter wall 352 surrounds the top portion of the recessed flange backing surface 353. In order to create the tag pocket 266, the top portion 284 is positioned adjacent to the bottom enclosure portion 276 such that the attachment features 285 are lined up with the attachment slots 354. The top portion 284 and the bottom enclosure portion 276 are then snapped together such that the tag flange 350 fits over and onto the tag backing surface 353. As a result, a tag pocket 266 is formed, which is defined by the tag flange 350, the top tag perimeter wall 351, and the bottom tag perimeter wall 352. The tag pocket 266 is recessed with respect to the adjacent surfaces of the top portion 284 and the bottom enclosure portion 276 such the identification tag 265 is protected during use.

The present invention provides a replaceable cartridge for use in a substrate printer that is self-locating and provides accurate positioning of the components of the cartridge that interface with components of the printer. The cartridge has rounded locating features designed to mate with rounded reference protrusions located in the printer, and the ribbon supply spool and ribbon take-up spool are located on either side of the cartridge locating features, such that the cartridge is balanced about the locating features, providing easier installation into the printer. Also, the positions of the interfacing components of the cartridge are located with reference to the locating features in order to minimize inaccuracies that are present in cartridge designs having interfacing components that are not located with respect to a common locating feature.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A replaceable ribbon cartridge for use with a printer, said replaceable ribbon cartridge comprising:

a cartridge frame defining a first side, a second side, a supply spool retaining end and a take-up spool retaining end;

a supply spool enclosure defined at the supply spool retaining end of the cartridge frame;

a take-up spool enclosure defined at the take-up spool retaining end of the cartridge frame;

a support plate that defines at least part of the first side of the cartridge frame between the supply spool retaining end and the take-up spool retaining end, wherein the support plate further defines:

a bias support surface adapted to receive a printer biasing element, a locating surface and a locating slot generally proximate a mid-point of the locating surface, located between the supply spool retaining end and the take-up spool retaining end, and an upper surface comprising both a first surface and the bias support surface, wherein a first distance is defined between the first surface and the locating surface, wherein a second distance is defined between the bias support surface and the locating surface, and wherein the second distance is greater than the first distance.

2. The replaceable ribbon cartridge of claim 1, further comprising a second support plate that defines at least part of the second side of the cartridge frame between the supply spool retaining end and the take-up spool retaining end, wherein the second support plate defines a second bias support surface adapted to receive a second printer biasing element.

3. The replaceable ribbon cartridge of claim 1, wherein the bias support surface is positioned generally between the supply spool retaining end and the first surface.

4. The replaceable ribbon cartridge of claim 1, further comprising an indentation defined by the cartridge frame generally below the supply spool enclosure and generally proximate the supply spool retaining end.

5. The replaceable ribbon cartridge of claim 4, wherein the indentation defines a substantially curved upper surface positioned below the supply spool enclosure.

6. The replaceable ribbon cartridge of claim 1, further comprising a cleaning roller extending from the cartridge frame proximate the supply spool retaining end.

7. The replaceable ribbon cartridge of claim 6, wherein the cleaning roller is coupled to the cartridge frame by first and second cleaning roller springs.

8. The replaceable ribbon cartridge of claim 7, wherein the cleaning roller is cantilevered by the first and second cleaning roller springs.

9. A replaceable ribbon cartridge for use with a printer, said replaceable ribbon cartridge comprising:

a cartridge frame defining a first side, a second side, a supply spool retaining end and a take-up spool retaining end;

a supply spool enclosure defined at the supply spool retaining end of the cartridge frame;

a take-up spool enclosure defined at the take-up spool retaining end of the cartridge frame;

a first support plate that defines at least part of the first side of the cartridge frame between the supply spool retaining end and the take-up spool retaining end, wherein the first support plate defines:

a first bias support surface adapted to receive a first printer biasing element, a first locating surface and a first locating slot, an upper surface comprising both a first surface and the first bias support surface, wherein a first distance is defined between the first surface and the first locating surface, wherein a second distance is defined between the first bias support surface and the first locating surface, and wherein the second distance is greater than the first distance;

a second support plate that defines at least part of the second side of the cartridge frame between the supply spool retaining end and the take-up spool retaining end, wherein the second support plate defines a second bias support surface adapted to receive a second printer biasing element and wherein the second support plate further comprises a second locating surface and a second locating slot;

a first indentation defined by the cartridge frame generally below the supply spool enclosure; and a second indentation defined by the cartridge frame generally below the supply spool enclosure.

10. The replaceable ribbon cartridge of claim 9, wherein the cartridge frame defines a maximum width between the first side and the second side, the cartridge frame defines a minimum width between the first indentation and the second indentation, and wherein the maximum width is larger than the minimum width.

11. The replaceable ribbon cartridge of claim 9, wherein the first indentation defines a first curved upper surface generally below the supply spool enclosure, and wherein the second indentation defines a second curved upper surface generally below the supply spool enclosure.

12. The replaceable ribbon cartridge of claim 9, further comprising a cleaning roller coupled to the cartridge frame proximate the first indentation and the second indentation.

13. The replaceable ribbon cartridge of claim 12, wherein the first indentation defines a first cutout proximate the cleaning roller, and wherein the second indentation defines a second cutout proximate the cleaning roller.

* * * * *

UNITED STATES PATENT AND TRADEMARK OFFICE

CERTIFICATE OF CORRECTION

PATENT NO. : 7,934,881 B2
APPLICATION NO. : 11/379279
DATED : May 3, 2011
INVENTOR(S) : Lodwig et al.

It is certified that error appears in the above-identified patent and that said Letters Patent is hereby corrected as shown below:

On the Title page,
Insert the following Related U.S. Application Data:
Item --(63) Continuation-in-part of Application No. 10/690,395, filed on October 20, 2003--.

Column 1,
Lines 7-11, in the CROSS-REFERENCES TO RELATED APPLICATIONS
"This application claims priority to U.S. Provisional Application Ser. No. 60/672,642, filed Apr. 19, 2005, and to copending U.S. patent application Ser. No. 10/690,395, filed on Oct. 20, 2003, both of which are hereby incorporated herein in their entirety by reference." should read:
--This application claims priority to U.S. Provisional Application Ser. No. 60/672,642, filed Apr. 19, 2005, and is a continuation-in-part of U.S. patent application Ser. No. 10/690,395, filed on October 20, 2003, now abandoned, both of which are hereby incorporated herein in their entirety by reference.--.

Column 10,
Line 36, "0.46 and 1.06" should read --0.46 and 1.06 inches--.

Signed and Sealed this
Fifth Day of June, 2012

David J. Kappos

David J. Kappos
*Director of the United States Patent and Trademark Office*